US011551707B2

(12) United States Patent
Hsu et al.

(10) Patent No.: US 11,551,707 B2
(45) Date of Patent: Jan. 10, 2023

(54) SPEECH PROCESSING METHOD, INFORMATION DEVICE, AND COMPUTER PROGRAM PRODUCT

(71) Applicant: RELAJET TECH (TAIWAN) CO., LTD., Taipei (TW)

(72) Inventors: Yun-Shu Hsu, Taipei (TW); Po-Ju Chen, Taipei (TW)

(73) Assignee: RELAJET TECH (TAIWAN) CO., LTD., Taipei (TW)

( * ) Notice: Subject to any disclaimer, the term of this patent is extended or adjusted under 35 U.S.C. 154(b) by 60 days.

(21) Appl. No.: 17/271,197

(22) PCT Filed: Aug. 27, 2019

(86) PCT No.: PCT/CN2019/102912
§ 371 (c)(1),
(2) Date: Feb. 24, 2021

(87) PCT Pub. No.: WO2020/043110
PCT Pub. Date: Mar. 5, 2020

(65) Prior Publication Data

US 2021/0249033 A1 Aug. 12, 2021

(30) Foreign Application Priority Data

Aug. 28, 2018 (CN) ..... 201810988537.1

(51) Int. Cl.
*G10L 25/30* (2013.01)
*G10L 21/0208* (2013.01)

(52) U.S. Cl.
CPC ..... *G10L 25/30* (2013.01); *G10L 21/0208* (2013.01)

(58) Field of Classification Search
CPC ..... G10L 25/30; G10L 21/0208
(Continued)

(56) References Cited

U.S. PATENT DOCUMENTS 9,304,736 B1 4/2016 Whiteley et al.
9,934,785 B1 4/2018 Hulaud
(Continued)

FOREIGN PATENT DOCUMENTS

CN 107293289 A 10/2017
CN 107563417 A 1/2018
(Continued)

OTHER PUBLICATIONS

F. Fang, J. Yamagishi, I. Echizen and J. Lorenzo-Trueba, "High-Quality Nonparallel Voice Conversion Based on Cycle-Consistent Adversarial Network," 2018 IEEE International Conference on Acoustics, Speech and Signal Processing (ICASSP), 2018, pp. 5279-5283, doi: 10.1109/ICASSP.2018.8462342. Year: 2018 (Year: 2018).*

(Continued)

*Primary Examiner* — Bharatkumar S Shah
(74) *Attorney, Agent, or Firm* — Liu & Liu

(57) ABSTRACT

Disclosed is a method for speech processing, an information device, and a computer program product. The method for speech processing, as implemented by a computer, includes:

obtaining a mixed speech signal via a microphone, wherein the mixed speech signal includes a plurality of speech signals uttered by a plurality of unspecified speakers at the same time;

generating a set of simulated speech signals according to the mixed speech signal by using a Generative Adversarial Network (GAN), in order to simulate the plurality of speech signals;

determining the number of the simulated speech signals in order to estimate the number of the speakers in the surroundings and providing the number as an input of an information application.

19 Claims, 2 Drawing Sheets

(58) Field of Classification Search
USPC ..... 704/202
See application file for complete search history.

(56) References Cited

U.S. PATENT DOCUMENTS

| | | | | |
|---|---|---|---|---|
| 2015/0269933 | A1* | 9/2015 | Yu | G10L 17/18 704/232 |
| 2015/0279387 | A1 | 10/2015 | List | |
| 2016/0336005 | A1 | 11/2016 | Cao et al. | |
| 2017/0060519 | A1 | 3/2017 | Roberdet et al. | |
| 2019/0318725 | A1* | 10/2019 | Le Roux | G10L 15/16 |
| 2019/0341055 | A1* | 11/2019 | Krupka | G10L 25/84 |
| 2021/0166705 | A1* | 6/2021 | Chang | G10L 21/038 |
| 2021/0289306 | A1* | 9/2021 | Bharitkar | H04R 3/005 |

FOREIGN PATENT DOCUMENTS

| | | | |
|---|---|---|---|
| CN | 107909153 | A | 4/2018 |
| JP | 2018063504 | A | 4/2018 |

OTHER PUBLICATIONS

G. Liu, J. Shi, X. Chen, J. Xu and B. Xu, "Improving Speech Separation with Adversarial Network and Reinforcement Learning," 2018 International Joint Conference on Neural Networks (IJCNN), 2018, pp. 1-7, doi: 10.1109/IJCNN.2018.8489444. (Year: 2018) (Year: 2018).*

International Search Report for International Application No. PCT/CN2019/102912.

Li, et al., "CBLDNN-Based Speaker-independent Speech Separation via Generative Adversarial Training", ICASSP 2018, http://sigport.org//documents/cbldnn-based-speaker-independent-speech-separation-generative-adversarial-training-0, Apr. 22, 2018 (Apr. 22, 2018), pp. 711-715.

Pascual, et al., "Segan: Speech Enhancement Generative Adversarial Network", http://arxiv.orgabs/1703.09452v3, Jun. 9, 2017 (Jun. 9, 2017), pp. 1-5.

Kwan, et al., "Speech Separation Algorithms for Multiple Speaker Environments," Proc. Int. Symposium on Neural Networks, (2008), pp. 1-5.

Isik, et al., "Single-Channel Multi-Speaker Separation Using Deep Clustering", arXiv:1607.02173v1, Jul. 7, 2016, pp. 1-5.

Subakan, et al., "Generative Adversarial Source Separation", arXiv:1710.10779, (2017), pp. 1-5.

Wang, et al., "Multi-Speaker Recognition in Cocktail Party Problem", CoRR, abs/1712.01742, (2017), pp. 1-8.

Li, et al., "Automatic Speaker Age and Gender Recognition Using Acoustic and Prosodic Level Information Fusion", Computer Speech and Language, vol. 27, No. 1, (2013), pp. 151-167.

Nayak, et al., "Speaker Dependent Emotion Recognition from Speech", International Journal of Innovative Technology and Exploring Engineering. vol. 3, Issue 6, (Nov. 2013), pp. 40-42.

* cited by examiner

SPEECH PROCESSING METHOD, INFORMATION DEVICE, AND COMPUTER PROGRAM PRODUCT

BACKGROUND OF THE INVENTION

Field of the Invention

The present invention in general relates to a computer-executed speech processing method and an information device, and more particularly, to a computer-executed speech processing method and an information device, which are capable of estimating the number of unspecified speakers in an environment according to a received mixed speech signal.

Description of the Prior Art

Information devices capable of speech detection and for users to perform control through speech are available as commercial smart speakers, and fundamental structures can be referred from products by Amazon, Amazon Echo, or products by Google, Google Home, for further understanding. Such type of devices in general include processors and are capable of executing various applications locally or in the cloud through networks, so as to provide various information services.

Further, for example, Google Home supports multiple users, i.e., providing individual users with different services. In order to identify users, individual users need to first register their voiceprints. A user first utters two wakeup terms including "OK Google" or "Hey Google" to Google Home. Google Home analyzes the wakeup terms to obtain features of the voiceprints of the user. The user then again utters "OK Google" or "Hey Google" to Google Home, and Google Home compares the sound with previously registered voiceprints to understand who is speaking.

On the other hand, current techniques are also capable of recognizing speech contents issued by a user. For example, specific terms in a user speech are recognized to further determine the current thing of interest of the user or the current emotion of the user, accordingly determining the service contents to be provided to the user. Associated details can be referred from the U.S. Pat. No. 9,934,785, or the U.S. Patent Publication No. 20160336005.

SUMMARY OF THE INVENTION

Although the current techniques can achieve recognition of a speaker and identification of words or speeches, there remains room for improvement. In particular, in order to provide services better meeting user requirements, identification for current environmental profiles and/or user behavior modes is still desired. Thus, the present invention acknowledges that, by identifying the number of speakers in an environment and the change in the number, an environmental profile and user behavior modes in the environment can be reasonably deduced.

Taking a home environment for example, within one day, most family members are out to work or to school in the daytime, and so the number of speakers in this environment in the daytime is the least, increases in the evening and may reach a maximum number at dinner time. In comparison, in a common office environment, the number of speakers is larger during working hours and gradually decreases after working hours. Thus, according to the number of speakers and the changing trend in the number in the daytime as well as other known information (e.g., geographical information learned through GPS data or IP addresses), the profile of an environment where a user is located can be more accurately determined, further providing customized services.

Current technique faces certain shortcomings although being capable of identifying the number of speakers by voiceprint recognition. First of all, the approach in current techniques such as voiceprint recognition by Google Home above, it is necessary to rely on users to first register their voiceprints, rendering inconvenience in actual use. Further, there are currently financial organizations that use voiceprints of users as an identity verification tool, and so certain users may be reluctant in providing voiceprint data as being worried about leakage and abuse of such data. Moreover, even if users are willing to register their voiceprints in advance, in a situation where multiple unspecified users have a conversation or speak simultaneously, i.e., the so-called "cocktail party problem", it is rather difficult to determine the number of speakers in the current environment merely by comparing the voiceprints registered in advance. When the number of speakers is uncertain, further distinguishing one after another the individual voiceprints and recognizing respective contents or separating voices of individual speakers become even more challenging.

In view of the above, a computer-executed speech processing method and an information device are provided according to an aspect of the present invention. The computer-executed speech processing method and the information device can adopt a deep learning approach, in particular a generative adversarial network (GAN) model, so as to estimate the number of unspecified speakers in an environment from a received mixed speech signal, and preferably, without users providing in advance voiceprints thereof (i.e., registering voiceprints in advance).

According to another aspect of the present invention, once the number of unspecified speakers in the environment is estimated, an environmental profile and behavior modes of users in the environment are accordingly deduced, and appropriate services can be provided. To achieve the above, speech samples of the speakers in the environment can be repeatedly acquired according to a predetermined timetable or a specific condition so as to observe the changing trend.

For example, if sufficient speech samples of speakers can be acquired each day, it can be deduced that the environment is likely to be a home; in contrast, if sufficient speech samples of speakers can be acquired only on workdays, it can be deduced that the environment is an office. From the estimated number of speakers and changing trend thereof in the environment, family composition or business patterns of an office can be further deduced. For instance, taking a home as the environment as an example, the number of family members still attending school can be deduced from the increase in the number of speakers from the time getting off school; taking an office as the environment as an example, it can be deduced whether working overtime is normal or whether a flexible working hour system is adopted from the estimated number of speakers after the time getting off work (e.g., six o'clock in the evening).

A computer-executed speech processing method, related to a generative adversarial network (GAN), is provided according to an embodiment of the present invention, wherein the GAN includes a generative network and a discriminator network. The method comprises: obtaining a mixed speech signal via a microphone, wherein the mixed speech signal at least comprises a plurality of speech signals uttered by a plurality of speakers within a period; providing the mixed speech signal to the generative network, and the generative network generating a set of simulated speech signals by using a generative model according to the mixed speech sample signal to simulate the plurality of speech signals, wherein a parameter in the generative model is determined by the generative network and the discriminator network through continuous adversarial learning; and determining the number of signals in the set of simulated speech signals, and providing the number of signals as an input of an information application.

A computer-executed speech processing method is provided according to an embodiment of the present invention. The method comprises: obtaining a mixed speech signal via a microphone, wherein the mixed speech signal at least includes a plurality of speech signals uttered by a plurality of speakers within a period; generating a set of simulated speech signals according to the mixed speech sample signal to simulate the plurality of speech signals, wherein the plurality of speech signals uttered by the plurality of speakers are not provided in advance as samples; and determining the number of signals in the set of simulated speech signals, and providing the number of signals as an input of an information application.

Moreover, the present invention further provides a computer program product including a computer-readable program, to execute the method above when executed on an information device.

An information device is further provided according to another embodiment of the present invention. The information device includes: a processor, for executing an audio processing program and an information application; and a microphone, for receiving a mixed speech signal, wherein the mixed speech signal at least includes a plurality of speech signals simultaneously uttered by a plurality of speakers. Wherein, the processor executes the audio processing program to execute the method above.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The following description, the appended claims, and the embodiments of the present invention further illustrate the features and advantages of the present invention.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE EMBODIMENTS

Figure 1:
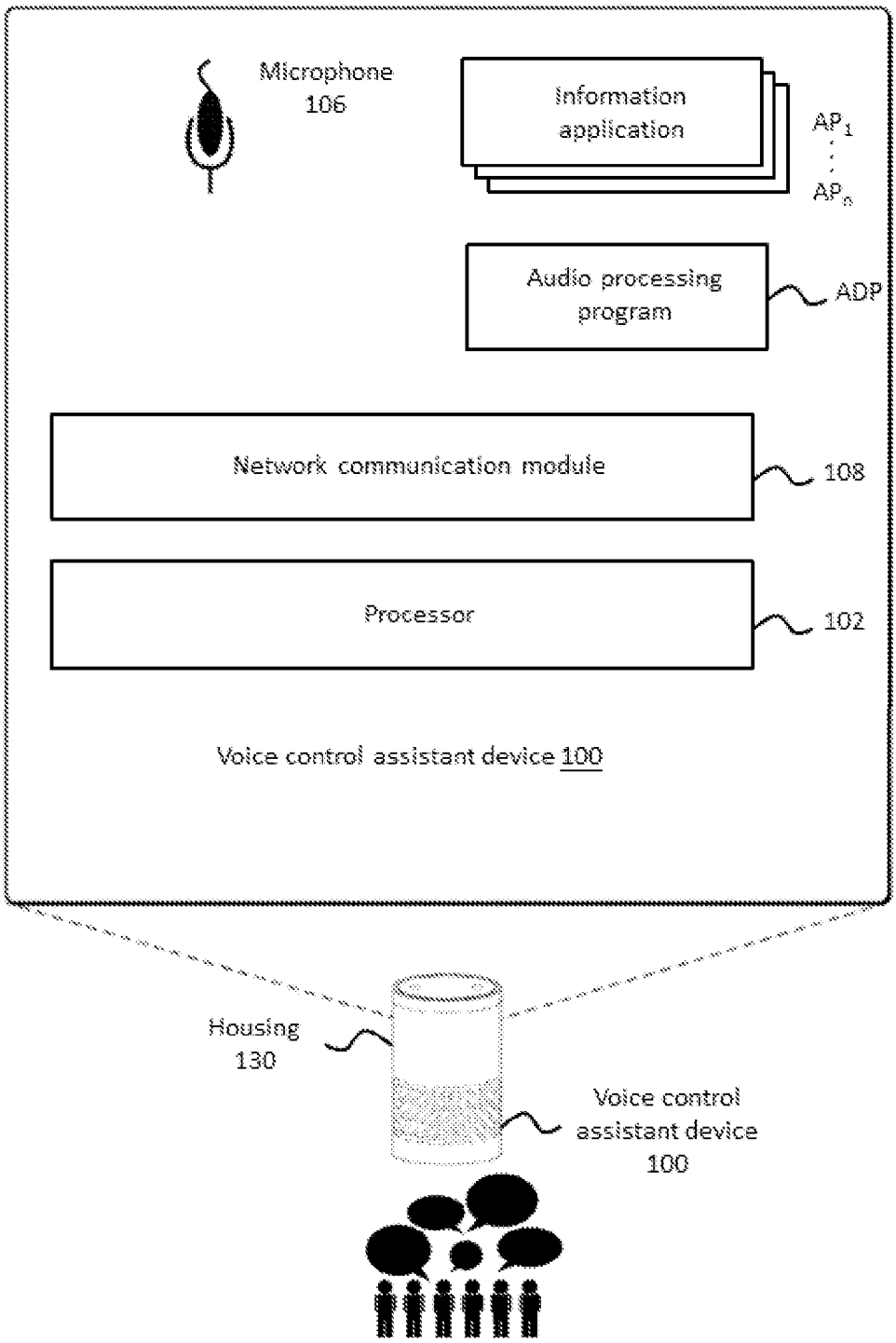
FIG. 1 is an information device according to a specific embodiment of the present invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

As will be appreciated by one skilled in the art, the present invention may be embodied as a computer device, a method or a computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer or server may be connected to the user's computer through any type of network, including a local area network (LAN) or a wide area network (WAN), or the connection may be made to an external computer (for example, through the Internet using an Internet Service Provider).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Figure 2:
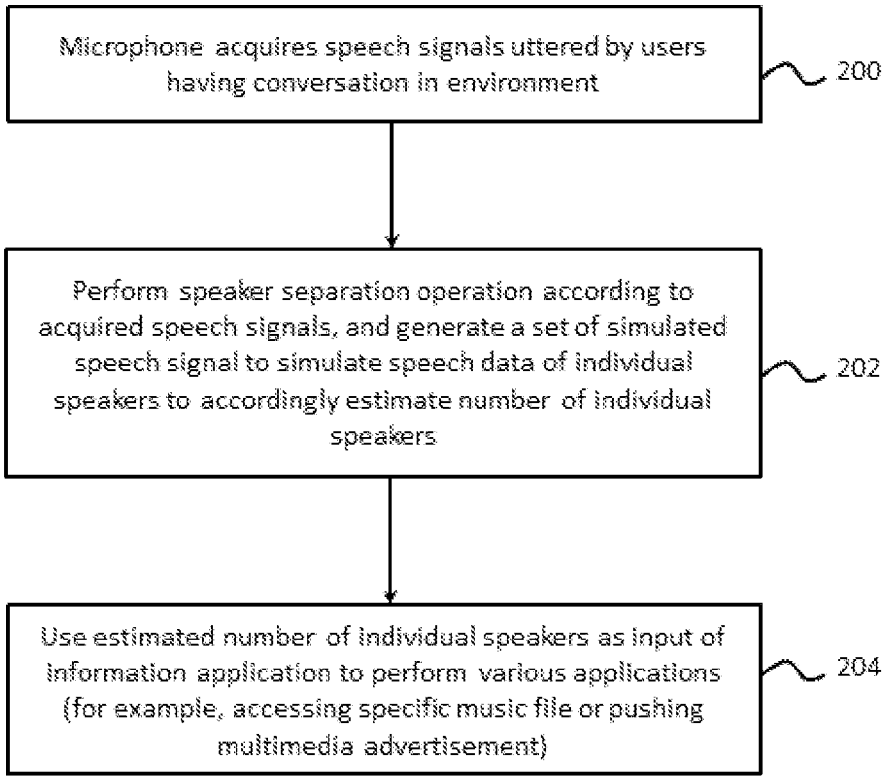
FIG. 2 is a flowchart of a method according to an embodiment of the present invention.

Referring now to FIG. 1 through FIG. 2, devices, methods, and computer program products are illustrated as structural or functional block diagrams or process flowcharts according to various embodiments of the present invention. The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

<System Architecture>

A voice control assistant device 100 is taken as an example to describe an information device set forth by the present invention. It should be noted that, the information device of the present invention is not limited to being a voice control assistant device, and may be a smartphone, a smart watch, a smart digital hearing aid, a personal computer or a tablet computer.

FIG. 1 shows the hardware architecture of the voice control assistant device 100 according to an embodiment. The voice control assistant device 100 may include a housing 130, and a processor 102 and one or more microphones (or other speech input apparatuses) 106 arranged in the housing 130. The processor 102 may be a microcontroller, a digital signal processor (DSP), a universal processor, or an application-specific integrated circuit (ASIC); however, the present invention is not limited thereto. The number of the microphone 106 may be one, and may have a single-channel or multi-channel (e.g., left and right channels) sound acquisition function. Moreover, the voice control assistant device 100 further includes a network communication module 108 for performing wired or wireless communication (e.g., via Bluetooth, infrared or Wi-Fi), or directly or indirectly linking to a local area network (LAN), a mobile phone network or the Internet.

In the voice control assistant device 100, fundamental structures not directly related to the present invention, such as power, memory and speaker, can be referred from a common voice control assistant device, for example, products by Amazon, Amazon Echo, or products by Google, Google Home, and more specifically, can be referred from the U.S. Pat. No. 9,304,736, or the U.S. Patent Publication No. 20150279387 A1. These details irrelevant to the present invention are omitted from the description.

The processor 102 executes an operating system (not shown), e.g., the Android operating system or Linux. The processor 102 can execute various information applications $AP_1$ to $AP_n$ under the operating system. For example, the various information applications $AP_1$ to $AP_n$ may be used to connect to various Internet services, e.g., multimedia pushing or streaming, online financing and online shopping. It should be noted that the information applications $AP_1$ to $AP_n$ do not necessarily need a networking environment in order to provide services. For example, the voice control assistant device 100 may include a storage unit (not shown), which can store multimedia files locally, e.g., music files, for access by the information applications $AP_1$ to $AP_n$, and does not necessarily rely on networking.

The processor 102 may further execute an audio processing program ADP, which can be used to acquire, recognize or process speech signals uttered by one or more users speaking or having conversations in an environment where the voice control assistant device 100 is located. Fundamental contents of the audio processing program ADP that are not directly related to the present invention can be referred from the speech recognition process of general voice control assistant devices such as products by Amazon, Alexa, or products by Google, Google Assistant. Features of the audio processing program ADP that are related to the present invention are further described in detail with the flowchart in FIG. 2 below.

It should be noted that, the voice control assistant device 100 may also be implemented as an embedded system; in other words, the information applications $AP_1$ to $AP_n$ and the audio processing program ADP may also be implemented as firmware of the processor 102. Further, if the information device of the present invention is to be implemented in form of a smartphone, the information applications and the audio processing program can be obtained from an online application marketplace (e.g., Google Play or App Store)—such is not limited by the present invention.

<Audio Processing>

In step 200, the microphone 106 continuously acquires speech signals uttered by one or more users speaking or having conversations in an environment. The audio processing program ADP can perform subsequent processing on the acquired speech signals (refer to steps 202 to 204 below) according to a predetermined timetable or according to a specific condition. For example, the audio processing program ADP performs subsequent processing on the acquired speech signals at a fixed interval of every 20 minutes or 30 minutes, or when the volume of speech detected in the environment is greater than a threshold. The time length of speech samples used by the audio processing program ADP can be from 3 seconds to 1 minute. Moreover, the audio processing program ADP can automatically adjust the time length or file size of the required speech samples according to requirements. Theoretically, the information provided becomes more abundant as the time or file size of the speech samples used increases, which promotes the accuracy of subsequent determination and however consumes more processing resources at the same time.

It should be noted that, in this embodiment, before the subsequent processing is performed, the audio processing program ADP in this step is not yet capable of determining or estimating speech signals of how many speakers are actually included in the speech signals acquired by the microphone 106.

In step 202: in this step, the acquired speech signals are segmented into thousands or tens of thousands of segments per second, and the amplitude of acoustic waves of the segment after quantization is represented by digits. After the acquired speech signals are converted to digital information, the audio processing program ADP further performs a speaker separation operation by using the converted digital information, so as to separate speech data of individual speakers and to accordingly determine the number of individual speakers.

The speaker separation operation can be performed locally, i.e., processed by calculation resources of the processor 102; alternatively, the data may also be sent by the audio processing program ADP to the network and be processed by calculation resources in the "cloud"—such is not limited by the present invention.

It should be noted that, in this step, the speech data of the individual speakers and the determined number of the individual speakers obtained and determined by the audio processing program ADP are obtained according to the algorithm used. It should be noted that, results obtained from different algorithms may be different, and may contain errors from actual values.

Regarding the speaker separation operation, in one embodiment, reference can be made to C. Kwan, J. Yin, B. Ayhan, S. Chu, K. Puckett, Y. Zhao, K. C. Ho, M. Kruger, and I. Sityar, "Speech Separation Algorithms for Multiple Speaker Environments," Proc. Int. Symposium on Neural Networks, 2008. This technique uses multiple microphones or a multi-channel microphone to sample speech signals.

In another embodiment, a deep learning method is used, and reference can be made to Yusuf Isik, Jonathan Le Roux, Zhuo Chen, Shinji Watanabe, and John R Hershey, "Single-channel multi-speaker separation using deep clustering," arXiv preprint rXiv:1607.02173, 2016.

In another embodiment particularly (but not limited to) when the microphone 106 receives and acquires by a single channel the speech signals in the environment where it is located, a GAN model is preferably used. The audio processing program ADP performs the required speaker separation operation on the sampled speech signals (which may be a mixed signal mixed with conversations of a plurality of speakers) by using a pre-trained generative network model to generate a set of simulated speech signals, of which the output distribution simulates speech signals uttered by individual speakers in the sampled mixed speech signal. The number of the set of simulated speech signals is then used as the estimated number of individual speakers.

The GAN includes a generative network and a discriminator network. Different from other deep learning techniques, first of all, the learning process of the GAN is not a monitoring type and hence saves immense amount of training manpower. Secondly, the GAN relates to two independent models, i.e., the models respectively used by the generative network and the discriminator model. Parameters of these two models are determined by means of continuous adversarial learning, and thus have a higher accuracy and can process a situation of mixed speeches of a larger number of speakers (e.g., in an office environment). Further, the learning process of the GAN does not require users to provide voiceprint samples in advance, and yet is capable of maintaining a high accuracy, which provides a greater advantage compared to the approach by Google Home in the prior art.

More details of implementing speaker separation using the GAN can be referred from Y. Cem Subakan and Paris Smaragdis. Generative adversarial source separation. arXiv preprint arXiv:1710.10779, 2017. However, the present invention is not limited to a specific GAN algorithm, but is preferably applicable to processing a situation of a larger number of speakers.

It should be noted that, the generative network model algorithm above can be coded as a part of the audio processing program ADP, and so the associated operations can be completed locally. However, the parameters used in the generative network model algorithm above can also be continuously updated through the network. Alternatively, the generative network model algorithm above can also be implemented in the "cloud", thereby saving the issue of needing frequent update.

In step 204, the estimated number of speakers in step 202 above is used as a data input for performing various applications. Further description is given with several examples below.

In a first embodiment, the number of speakers is used as auxiliary data that can be provided to the audio processing program ADP (or the information applications $AP_1$ to $AP_n$), and the speech samples acquired by the microphone 106 in step 200 are further analyzed, e.g., performing calculation and analysis using other different algorithm models. For example, in a family environment of a family of four members, each of the users in the family has registered in advance the voiceprints thereof, and thus the currently estimated number of speakers (e.g., currently only the mother and two children are talking to one another at home) in step 204 can be used as auxiliary data, which helps the audio processing program ADP to further recognize the voiceprints from the individual users from the mixed speech sample, further processing a voice instruction of one of the users (e.g., the son). Associated details can be referenced from Wang, Y., & Sun, W. (2017), Multi-speaker Recognition in Cocktail Party Problem. CoRR, abs/1712.01742.

In a second embodiment, the currently estimated number of speakers is used as reference data and as an input provided to the information application $AP_1$. For example, the application program $AP_1$ may be a music streaming service program similar to Spotify, and so the information application $AP_1$ can selectively play different playlists according to the currently estimated number of speakers, e.g., automatically selecting a playlist of a more tranquil music genre, when there are fewer people. Related techniques of accessing specific multimedia data according to the type of environment can be further referenced from the U.S. Patent Publication No. 20170060519, and are omitted herein.

Additionally, if the algorithm used can further recognize personal characteristics data such as age, gender, emotion and preferences of a user from voiceprints of individual users, such data can be together provided to the information application $AP_1$ as reference for selecting a specific playlist (or a specific multimedia file) to be accessed. Associated reference data can be seen in M. Li, K. J. Han, and S. Narayanan, "Automatic speaker age and gender recognition using acoustic and prosodic level information fusion," Computer Speech and Language, vol. 27, no. 1, pp. 151 to 167, 2013, Nayak, Biswajit & Madhusmita, Mitali & Kumar Sahu, Debendra & Kumar Behera, Rajendra & Shaw, Kamalakanta. (2013) "Speaker Dependent Emotion Recognition from Speech". International Journal of Innovative Technology and Exploring Engineering. 3. 40 to 42. It should be noted that this part is not essential in the present invention, and it should be understood that if the number of speakers cannot be first accurately estimated, subsequent voiceprint recognition of individual users will be quite challenging.

Compared to the information application $AP_1$ in the second embodiment using only the currently estimated number of speakers as an input for reference data, in a third embodiment, the number of speakers in the environment is repeatedly estimated, as repeatedly performing steps 200 to 204 according to the predetermined timetable or according to a specific condition, and so the changing trend in the number of speakers can be obtained to further deduce whether the environment is a home or an office, or even, for example, family composition or business patterns of an office can be deduced. For example, the information application $AP_1$ can be a music streaming service similar to Spotify, and the information application $AP_1$ can then automatically select a specific playlist (or a multimedia file) according to the family composition or the business pattern of the office. For another example, the information application $AP_2$ can be an online shopping program, and so the information application $AP_2$ can push advertisement information of a specific merchandise according to the family composition or the business pattern of the office.

It should be noted that, as previously described, the estimated number of speakers may differ from an actual value by an error, depending on the quality of the algorithm. However, since a certain regularity exists between an environmental profile and user behaviors of a predetermined environment, and drastic changes are rare, the estimation accuracy can be improved by statistical means through multiple rounds of estimation over an extended period of time (e.g., the situation of the third embodiment), and the result can be used as reference for further adjustment or update of the algorithm.

The foregoing preferred embodiments are provided to illustrate and disclose the technical features of the present invention, and are not intended to be restrictive of the scope of the present invention. Hence, all equivalent variations or modifications made to the foregoing embodiments without departing from the spirit embodied in the disclosure of the present invention should fall within the scope of the present invention as set forth in the appended claims.

DESCRIPTION OF THE REFERENCE NUMBERS voice control assistant device 100
processor 102
microphone 106
network communication module 108
housing 130
step 200
step 200
step 204
information applications $AP_1$-$AP_n$
audio processing program ADP

What is claimed is:

1. A computer-executed speech processing method, related to a Generative Adversarial Network (GAN), the GAN comprising a generative network and a discriminator network, the method comprising:

(a) obtaining a mixed speech signal via a microphone, wherein the mixed speech signal at least comprises a plurality of speech signals uttered by a plurality of speakers within a period, wherein the number of the plurality of speakers is unknown and non-predetermined;

(b) providing the mixed speech signal to the generative network, and, in order to simulate each of the plurality of speech signals uttered by the plurality of speakers, the generative network separating the mixed speech signal into respective simulated speech signals, wherein a parameter in the generative model is determined by the generative network and the discriminator network through continuous adversarial learning; and (c) determining the number of the simulated speech signals generated by the generative network in the step (b) as an estimation of the number of the plurality of speakers, and providing the number as an input of an information application.

2. The method of claim 1, wherein the plurality of speech signals uttered by the plurality of speakers are not provided in advance as samples to the GAN.

3. A computer program product stored in a on a non-transitory computer-usable medium, comprising a computer-readable program, for executing the method of claim 2 when executed on an information device.

4. An information device, comprising:

a processor, for executing an audio processing program and an information application; and a microphone, for receiving a mixed speech signal, wherein the mixed speech signal at least comprises a plurality of speech signals simultaneously uttered by a plurality of speakers, wherein the processor executes the audio processing program to execute the method of claim 2.

5. The method of claim 1, further comprising:

identifying voiceprints of the plurality of speech signals uttered by the plurality of speakers by using the number of signals in the set of simulated speech signals.

6. A computer program product stored in a on a non-transitory computer-usable medium, comprising a computer-readable program, for executing the method of claim 5 when executed on an information device.

7. An information device, comprising:

a processor, for executing an audio processing program and an information application; and a microphone, for receiving a mixed speech signal, wherein the mixed speech signal at least comprises a plurality of speech signals simultaneously uttered by a plurality of speakers, wherein the processor executes the audio processing program to execute the method of claim 5.

8. The method of claim 1, wherein steps (a) to (c) are repeated according to a predetermined timetable or condition to provide a plurality of inputs to the information application, and the information application executes a specific application according to the plurality of inputs.

9. A computer program product stored in a on a non-transitory computer-usable medium, comprising a computer-readable program, for executing the method of claim 8 when executed on an information device.

10. An information device, comprising:

a processor, for executing an audio processing program and an information application; and a microphone, for receiving a mixed speech signal, wherein the mixed speech signal at least comprises a plurality of speech signals simultaneously uttered by a plurality of speakers, wherein the processor executes the audio processing program to execute the method of claim 8.

11. A computer program product stored in a on a non-transitory computer-usable medium, comprising a computer-readable program, for executing the method of claim 1 when executed on an information device.

12. An information device, comprising:

a processor, for executing an audio processing program and an information application; and a microphone, for receiving a mixed speech signal, wherein the mixed speech signal at least comprises a plurality of speech signals simultaneously uttered by a plurality of speakers, wherein the processor executes the audio processing program to execute the method of claim 1.

13. The information device of claim 12, wherein the microphone further receives the mixed speech signal by a single audio channel.

14. The information device of claim 12, wherein the information application determines an environmental profile of an environment where the information device is located according to the number of signals in the set of simulated speech signals.

15. The information device of claim 12, wherein the information application determines behaviors of a speaker in an environment where the information device is located according to the number of signals in the set of simulated speech signals.

16. The information device of claim 12, wherein the information application decides to access specific multimedia data according to the number of signals in the set of simulated speech signals.

17. A computer-executed speech processing method, comprising:

(a) obtaining a mixed speech signal via a microphone, wherein the mixed speech signal at least comprises a plurality of speech signals uttered by a plurality of speakers within a period, wherein the number of the plurality of speakers is unknown and non-predetermined;

(b) in order to simulate each of the plurality of speech signals uttered by the plurality of speakers, separating the mixed speech signal into respective simulated speech signals, wherein the plurality of speech signals uttered by the plurality of speakers are not provided in advance as samples; and (c) determining the number of the simulated speech signals obtained in the step (b) as an estimation of the number of the plurality of speakers, and providing the number as an input of an information application.

18. A computer program product stored in a on a non-transitory computer-usable medium, comprising a computer-readable program, for executing the method of claim 17 when executed on an information device.

19. An information device, comprising:

a processor, for executing an audio processing program and an information application; and a microphone, for receiving a mixed speech signal, wherein the mixed speech signal at least comprises a plurality of speech signals simultaneously uttered by a plurality of speakers, wherein the processor executes the audio processing program to execute the method of claim 17.

* * * * *